US008920292B1

(12) United States Patent
Myers et al.

(10) Patent No.: US 8,920,292 B1
(45) Date of Patent: Dec. 30, 2014

(54) EXERCISE DEVICE AND METHODS OF USE

(71) Applicants: Rhondalyn Gisele Myers, Raleigh, NC (US); Clifford Anthony Myers, Raleigh, NC (US)

(72) Inventors: Rhondalyn Gisele Myers, Raleigh, NC (US); Clifford Anthony Myers, Raleigh, NC (US)

( * ) Notice: Subject to any disclaimer, the term of this patent is extended or adjusted under 35 U.S.C. 154(b) by 0 days.

(21) Appl. No.: 14/229,643

(22) Filed: Mar. 28, 2014

Related U.S. Application Data

(63) Continuation-in-part of application No. 13/740,883, filed on Jan. 14, 2013.

(60) Provisional application No. 61/585,988, filed on Jan. 12, 2012.

(51) Int. Cl.
*A63B 22/06* (2006.01)
*A63B 69/16* (2006.01)

(52) U.S. Cl.
CPC ..... *A63B 22/0605* (2013.01); *Y10S 482/904* (2013.01)
USPC ..... 482/57; 482/60; 482/904

(58) Field of Classification Search
CPC ..... A63B 22/0605; A63B 2021/1609; A63B 2022/0652; A63B 2208/0233; A63B 22/0694
USPC ..... 482/51, 57–65, 133–137, 904, 910; 601/23–24, 33–36; 297/172, 158.2, 297/158.5, 170
See application file for complete search history.

(56) References Cited

U.S. PATENT DOCUMENTS

| | | | | |
|---|---|---|---|---|
| 6,716,143 | B1 * | 4/2004 | Martin | 482/92 |
| 7,648,447 | B2 * | 1/2010 | Andre | 482/60 |
| 8,512,210 | B2 * | 8/2013 | Shauli | 482/8 |
| 2010/0210425 | A1 * | 8/2010 | Bowser | 482/62 |
| 2011/0237403 | A1 * | 9/2011 | Huber et al. | 482/57 |

* cited by examiner

*Primary Examiner* — Loan H Thanh
*Assistant Examiner* — Jennifer M Deichl
(74) *Attorney, Agent, or Firm* — Coats & Bennett, P.L.L.C.

(57) ABSTRACT

An apparatus and methods of attaching an exercise device to a chair to provide for a user of the chair to perform exercises. The apparatus generally includes a chair support section configured to be attached to the chair, and an exercise device that includes a support that is positioned on the floor. The chair support section and exercise device are configured to be engaged together when the user is exercising.

20 Claims, 10 Drawing Sheets

EXERCISE DEVICE AND METHODS OF USE

RELATED APPLICATIONS

The present application is a continuation-in-part application of U.S. application Ser. No. 13/740,883 filed on Jan. 14, 2013, which claims benefit to U.S. Application Ser. No. 61/585,988 filed on Jan. 12, 2012. Each of these applications is hereby incorporated by reference in their entireties.

BACKGROUND

Many people spend large amounts of time sitting in chairs. This may include while they are at work, such as sitting in a chair and working at a computer terminal or working with papers on a desk. This may also include while at home, such as sitting and watching television, reading, or various other activities. These same people would like to be more active and get more exercise in their daily routines. Exercise helps to control weight, improve health conditions, fight disease, improve a person's mood, and boost energy. However, many people do not have enough time to exercise during the day.

Various devices have been configured to perform exercises while sitting in a chair and doing other activities. However, many of these devices are large and cumbersome making them impractical for many uses. Their relatively large size makes it difficult to correctly position relative to the chair being used by the person. Further, the large size prevents them from fitting into the relatively small spaces that are available, such as the small space that is available under a desk or table.

Further, the devices do not provide an effective workout for the person. The user does not exert much energy and therefore receives little gain while using the device. A person's heart rate or breathing does not become elevated while exercising with the device. Further, some devices require the user to focus their attention on the device itself instead of on some other activity. These devices are not applicable for use while at work or when performing another activity.

SUMMARY

One embodiment of the present application is directed to an apparatus for exercising when seated in a chair that is positioned on a floor. The apparatus includes an exercising device and a chair support. The exercising device includes an elongated support member with opposing first and second ends, a flat bottom to be positioned on the floor, an opposing top, and an interior channel extending inward from the first end. The exercising device also includes a pedal assembly with a first mount attached to the support member between the first and second ends, a wheel attached to the first mount, and pedals operatively attached to the wheel. The exercising device also includes a brake assembly with a second mount attached to the support member between the first and second ends with the second mount being longitudinally spaced away from the first mount. The exercising device also includes an elongated bar sized to fit within the interior channel of the support member and movable within the channel to adjust an amount of the bar extending outward from the first end of the support member with the bar including a first end sized to fit in the hollow interior and an opposing second end positioned away from the support member and including a receptacle. The chair support includes a base sized to fit on an underside of the chair, and a mount attached to the base and extending vertically outward from the base with the mount including an extension. The extension is sized to fit within the receptacle at the second end of the bar to attach together the exercising device and the chair support.

The apparatus may also include a housing that extends around the wheel, the first mount, and the brake assembly, with the housing being spaced away from the bottom of the support member.

Each of the interior channel and the bar may include rectangular cross-sectional shapes.

The first wheel may be aligned vertically above and directly over the top of the support member.

The brake assembly may include a wheel attached to the second mount, and the brake assembly wheel and the wheel of the pedal assembly may be in an overlapping arrangement along a length of the support member and laterally offset.

The apparatus may also include a connector that extends between and connects the base and the mount with the connector being adjustable to adjust a distance between the base and the mount.

The mount may include a vertical member that extends downward from the base when the base is attached to the chair with the extension extending perpendicularly outward from the vertical member.

Another embodiment is directed to an apparatus for exercising when seated in a chair that is positioned on a floor. The apparatus includes an exercising device and a chair support. The exercising device includes a base with an open channel, a pedal assembly mounted to the base, an elongated bar including opposing first and second ends with the bar being sized to fit within and be movable along the channel to selectively position the second end outward from the channel and away from the base, and a receptacle at the second end of the bar. The chair support includes a plate sized to fit on an underside of the chair, a mount with a vertical arm and a horizontal extension sized to engage with the receptacle, and at least one connector that extends between the plate and the mount to adjust a distance between the plate and the mount. The extension is sized to engage with the receptacle at the second end of the bar to attach together the exercising device and the chair support.

The plate may include a central section and a plurality of radially extending arms with the mount being positioned directly below the central section. Each of the extension, the bar, and the base may include substantially straight shapes that align together in a straight row when the exercising device is attached to the chair support.

The apparatus may be positioned on a top side of the bar to engage with the extension when the extension is spaced away from the floor.

The pedal assembly may be mounted directly over the base.

The extension may extend outward at an angle of 90 degrees from the vertical arm.

The extension may include a solid, substantially rectangular shape and the receptacle may include a substantially rectangular opening sized to receive the extension.

The apparatus may include a locking mechanism attached to the base to lock the position of the bar relative to the base.

Another embodiment is directed to a method of attaching an exercise device to a chair. The method includes attaching a chair support to an underside of the chair, positioning the exercise device in proximity to the chair with the exercise device including a base with a pedal assembly extending upward from the base, adjusting a bar within a channel in the base to position a receptacle at an end of the bar outward away from the base, locking a position of the bar relative to the base, aligning the bar and the base with a terminal end of the extension, and mating the receptacle at the end of the bar with the terminal end of the extension.

The method may include mating the receptacle at the end of the bar with the terminal end of the extension while the extension is positioned vertically above a floor that supports the chair.

The method may include engaging a pin of a locking device with an aperture in the bar and locking the position of the bar relative to the base.

The apparatus of the present invention includes an exercise device for use with an office chair containing a swivel base. The device preferably comprises a chair attachment which has a plurality of strap supports to connect to the swivel base (for example, one strap support to connect to each leg of the swivel base). The swivel base securely connects to the chair attachment and straps (which preferably include hook and-loop material) help keep the chair in place. The chair attachment is preferably rigidly but adjustably connected to the exercise device and it can be adjusted to be further or closer to the exercise device. Each strap support which connects to the swivel base preferably comprises a rigid material.

The exercise device is preferably a fixed recumbent bicycle apparatus with foot pedals—the exercise device can comprise a pedaling mechanism whereby the user may pedal while seated in the office chair. Optionally, there is an adjustable resistance mechanism—adjustable or not, the resistance is preferably magnetic. Optionally, there can be an electricity generator such that the exercise device converts the rotational energy into electricity which may be utilized to power an electric device (such as a laptop computer being used by the exerciser sitting in the chair). For example, the rotational energy of the wheel can be converted to electrical energy by the rotation of a pedal drive pulley or a sprocket which may lead to the rotation of a flywheel, ultimately leading to the rotation of an alternator. Optionally, a gauge display monitors electricity produced.

Optionally, exercising statistics such as calories burned, distance traveled, and the like are displayed to the user through a monitoring device; in such a case, preferably there is a USB drive attachment or similar recorder in order to allow one to record the data from his workout.

Optionally, there is a support arm to which various devices may be attached—the attachment may be any kind of desk or tray, or combination thereof.

Optionally, there is an exercise attachment, such as a telescopic pulley bar, in order to engage in exercise of one's upper body.

Optionally, there is a desk attached to the exercise device which desk contains a slide-out keyboard.

Preferably, the exercise device fits under a desk, which may be elevated.

The apparatus optionally comprises the chair as well.

The chair attachment (chair holder) and adjustable stabilizer bar can be made from many types of materials, including metal, plastic, rubber, and composite materials.

Preferably each exercise device has a computer which will allow the cycle to increase resistance, keep up with speed, distance, and time, etc. Some exercise devices will have a desk attached, or a swing arm that acts as a desk, although the inventors anticipate that most will not.

Preferably there is adjustment of both the height of the cylinder to connect to the piston of an office chair, and the distance from the office chair to the exercise device. Preferably, a male cylinder is screwed up or down in a female cylinder to fit the chair, then flexible straps which optionally can have holes or brackets that can accept a strap that will fit around any chair leg and hold the chair securely to the chair support. This should help keep the chair from making noise and shaking when the cycle is being used at high speeds and resistance. Preferably, the female cylinder is rigidly attached to an adjustable bar that attaches to the exercise device through a rectangular tubing. The bar can slide back and forth in the rectangular tubing and is preferably fixed in place with a screw or bolt to apply pressure to the adjustable bar to hold the bar and tubing rigidly together. Preferably, there are five flat supports attached to the top of the male cylinder. Each flat support is preferably strapped to a chair leg.

There is preferably a computer on the cycle to control the resistance to the pedals and to record time, distance, calories burned, speed, etc. There is optionally as well a flexible arm that could hold a keyboard or ipad to allow a user to work on a computer or iPad while exercising while sitting in his office chair. This flexible arm could be in a pedestal which allows a variety of adjustable keyboard trays to be attached, for example.

There is preferably a cover over the working mechanism of the exercise device. The cover can be made of metal, wood, or plastic, for example, and can be or resemble diamond plate. Preferably the exercise device, including cover, can be sized and shaped to fit under a standard cubicle desk.

In some embodiments, the apparatus of the present invention can include a chair support attached to an exercise device as described above. Additionally, the apparatus can include an integral monitor stand and/or an integral sliding adjustable keyboard holder and mouse surface. It can include as well the chair.

In some embodiments, the rigid support can pivot to allow a chair to pivot from side to side in relation to the exercise device.

Preferably, the apparatus of the present invention attaches to a large variety of chairs and is compact enough to fit under a desk or in a small space. Preferably, one can cycle all day long with multiple speeds or resistance. Preferably, one can cycle forward or backward to help increase circulation and build up strength in the legs and hips. Preferably, the exercise device includes a cycle unit which is no longer than 24 inches and not higher than about 16 or 17 inches, not counting the height of the computer stand (which is preferably less than 28" in height). The pedal mechanism is preferably about 10-16", but more preferably about 14", in diameter and keeps track of speed, miles, and time.

There can be sound insulation inside of the cover.

The integrated computer could use a program similar to an iFit program, for example, to show the user the street view as he pedals.

Preferably, the compact construction is designed to allow the exercise device of the present invention to have full functionality of a normal size recumbent bicycle, and to fit in a very small space and to attach to various styles of chairs.

One of the inventors installed a recumbent bike to replace a LA-Z-BOY® chair. She also installed one in their classroom to replace her computer chair, where it was seen by friends and family, but it was not discussed as an idea or concept for an invention with mass appeal with anyone but close family. When she first put it in the classroom, she posted it on a friend's Facebook page to show her how she multitasked, but she took it down as soon as she thought of making an office chair-bike. She can use her bike at school 6 or 7 hours a day without getting tired. She lost 16 pounds without dieting, and her knees and hips don't hurt anymore. But the bike's seat is uncomfortable and it takes up a lot of space. She needed a small version that allows the user to keep the bike parallel with their desk and they can easily rotate their chair from the pedals to their desk without a bar getting in the way.

The inventors' chair attachment allows one to pedal comfortably all day without making one's butt sore. It preferably fits in a cubicle so that a large company can place them in cubicles for employees. It will also preferably have the capability to hook up to a generator to generate power, for a laptop computer, for example.

The various aspects of the various embodiments may be used alone or in any combination, as is desired.

DETAILED DESCRIPTION

Figure 1:
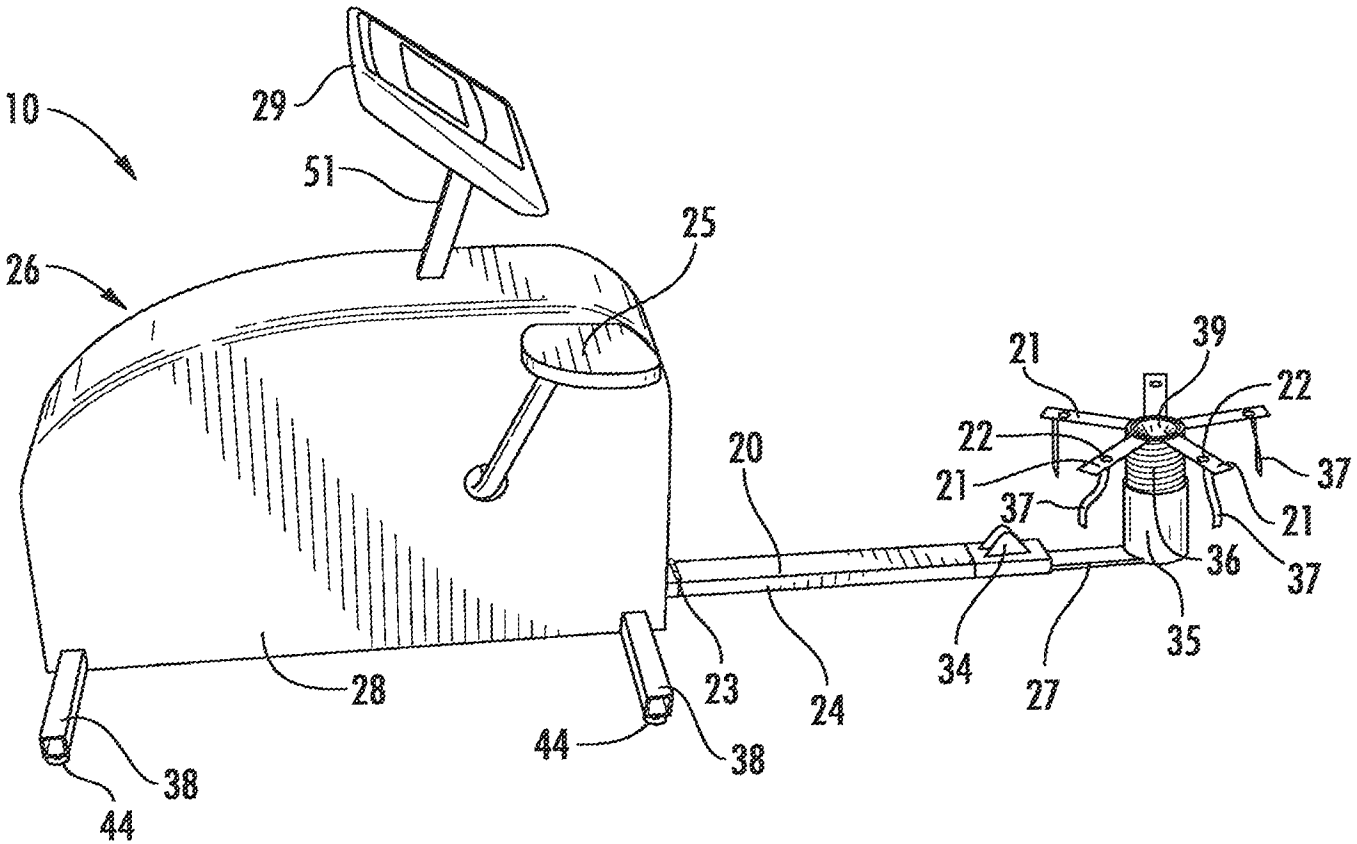
FIG. 1 is a perspective view of an embodiment of an exercise apparatus for use with a chair.
Figure 2:
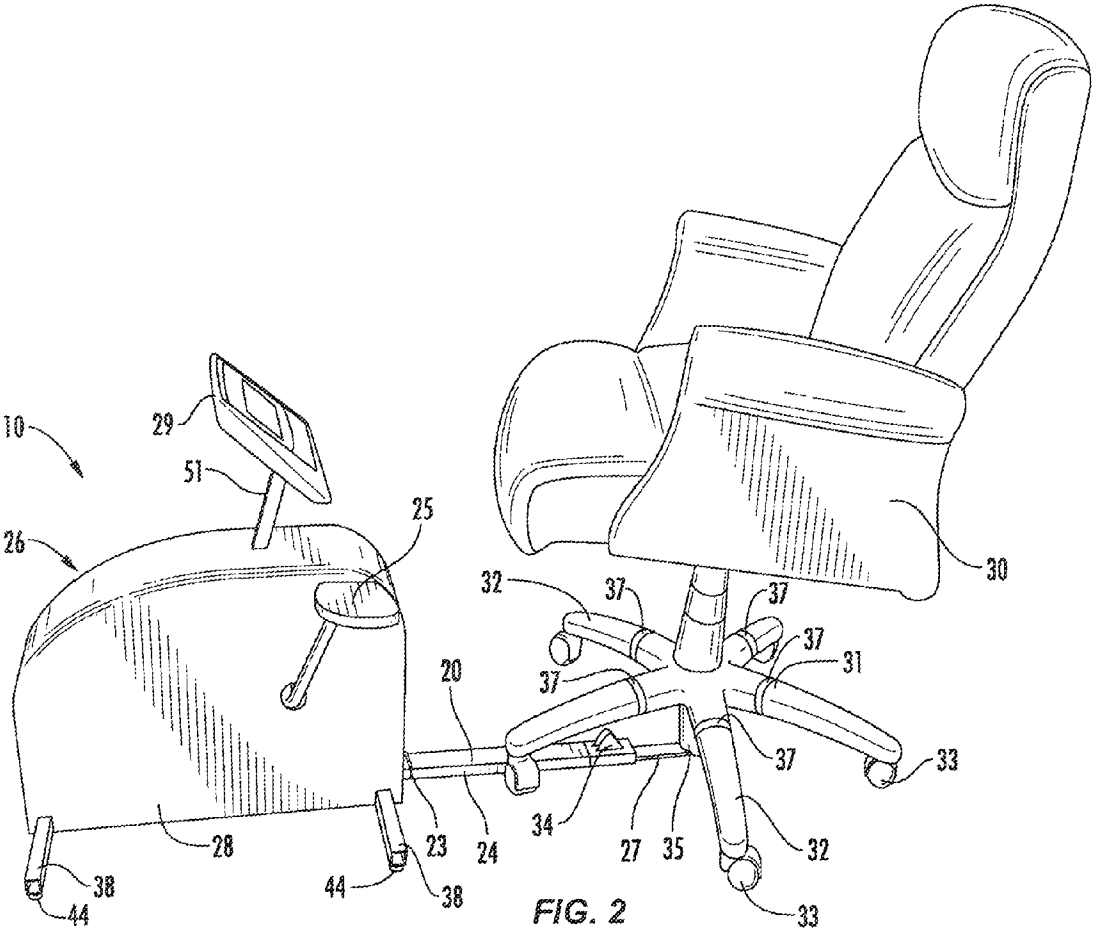
FIG. 2 is a perspective view of a chair attached to the device of FIG. 1.
Figure 3:
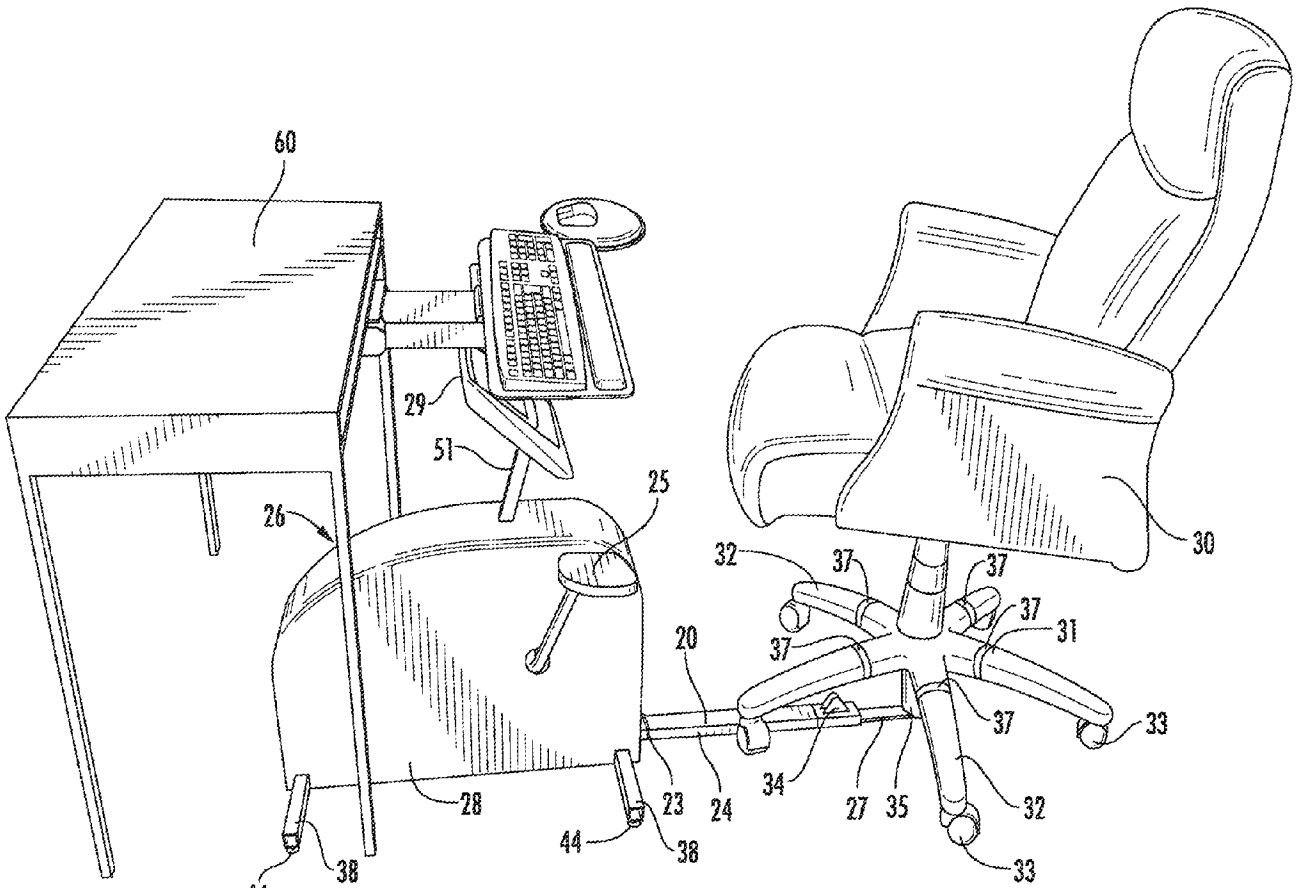
FIG. 3 is a perspective view of the apparatus and chair of FIG. 2 with the apparatus positioned under a desk.

FIGS. 1-3 show a first embodiment of the apparatus 10 of the present invention.

FIG. 2 shows a prior art office chair 30 having a swivel base 31 with five legs 32. Each leg 32 has a wheel 33 attached thereto.

Apparatus 10 includes an exercise device 26 which is attached to a chair support apparatus 20. Chair support apparatus 20 includes a rectangular tubing 24 attached with hinge 23 to exercise device 26. Rectangular tubing 24 receives a flat bar 27, to which is preferably rigidly attached internally threaded female cylinder 35. A locking device 34 (which could be a bolt) secures bar 27 relative to tubing 24. Locking device 34 could be any means of securing bar 27 relative to tubing 24, such as preferably by applying pressure to the adjustable bar 27 to hold the bar 27 and tubing 24 rigidly together. An externally threaded male cylinder 36 is received in female cylinder 35. Male cylinder 36 is preferably integral with five support arms 21 which correspond to legs 32 of chair 30. Cylinder 36 receives a piston of chair 30. Cylinder 36 can be conically shaped to receive pistons of different diameters.

Each support arm 21 preferably has a strap-receiving hole 22 for receiving a strap 37. Each strap 37 preferably uses hook-and-loop fasteners to secure the straps 37 around legs 32 to hold support arms 21 in contact with legs 32. Support arms 21 also act as strap supports. Exercise device 26 includes a cover 28 to protect a user from contact with most of the moving parts (not shown, but well known in the art) of the exercise device. Exercise device 26 includes pedals 25. Optionally, a computer 29 allows control of exercise device 26 and monitoring of statistics, as described elsewhere. Exercise device computer 29 is attached to cover 28 with a support post 51.

An optional stabilizing bar 38 helps to stabilize device 26.

FIG. 3 shows apparatus 10 in use under a standard office desk 60.

Figure 4:
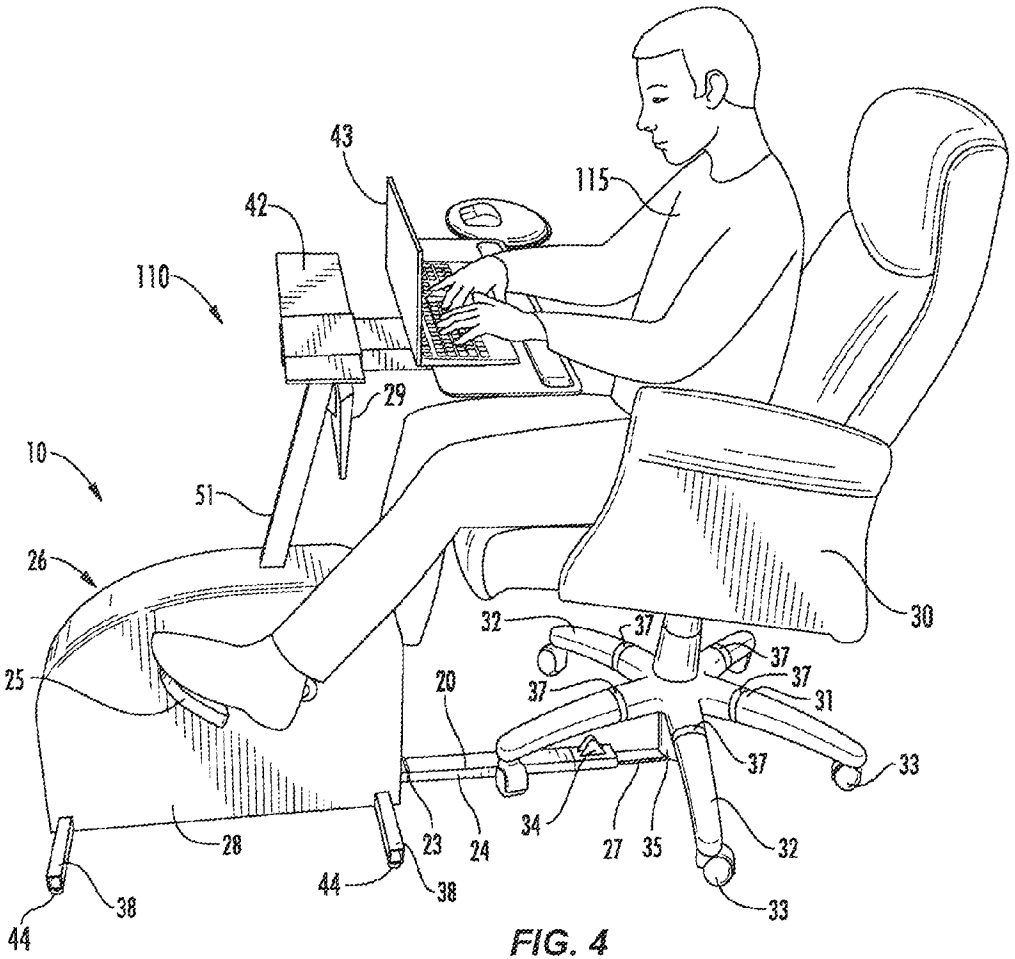
FIG. 4 is a perspective view of the apparatus and chair of FIG. 2 further including use with an integral desk being used by a person.

FIG. 4 shows apparatus 110 of another preferred embodiment of the present invention. Apparatus 110 includes a desktop attachment, with a desk support post 51 attached to cover 28 and an adjustable laptop computer desk 42 attached to post 51. A laptop computer 43 can rest on desk 42 and be used by user 115.

As shown in FIG. 1, cylinder 36 has an open center and which receives a rubber lining 39 that will preferably leave it with at least a 2" interior diameter. The rubber lining 39 preferably slopes out at the top like a funnel to the leg supports 21 so that practically all types of chair bases will fit inside the holder, almost like a Christmas tree holder. The rubber lining 39 protects the piston of chair 30.

The optional stabilizer bars 38 can be a flat bar with leg levelers 44 attached to the bottom. The actual shapes will vary and can include a rectangular bar with a filleted end to round out the ends. There can be a stabilizer bar 38 placed on each end for only one end) of the cover 28 to help the user use the exercise device at higher speeds and resistance without noise and shaking. Leg levelers 44 can be adjustable for example by screwing.

The adjustment bar from the machine to the chair can be hinged (as shown) or fit under the exercise device 26 to allow even longer legged people to use it easily.

Female cylinder 35 that attaches to the sliding bar 27 preferably has a larger diameter than the width of the bar, as much as for example 4" on the outside.

Device 26 is preferably symmetrical.

Figure 5:
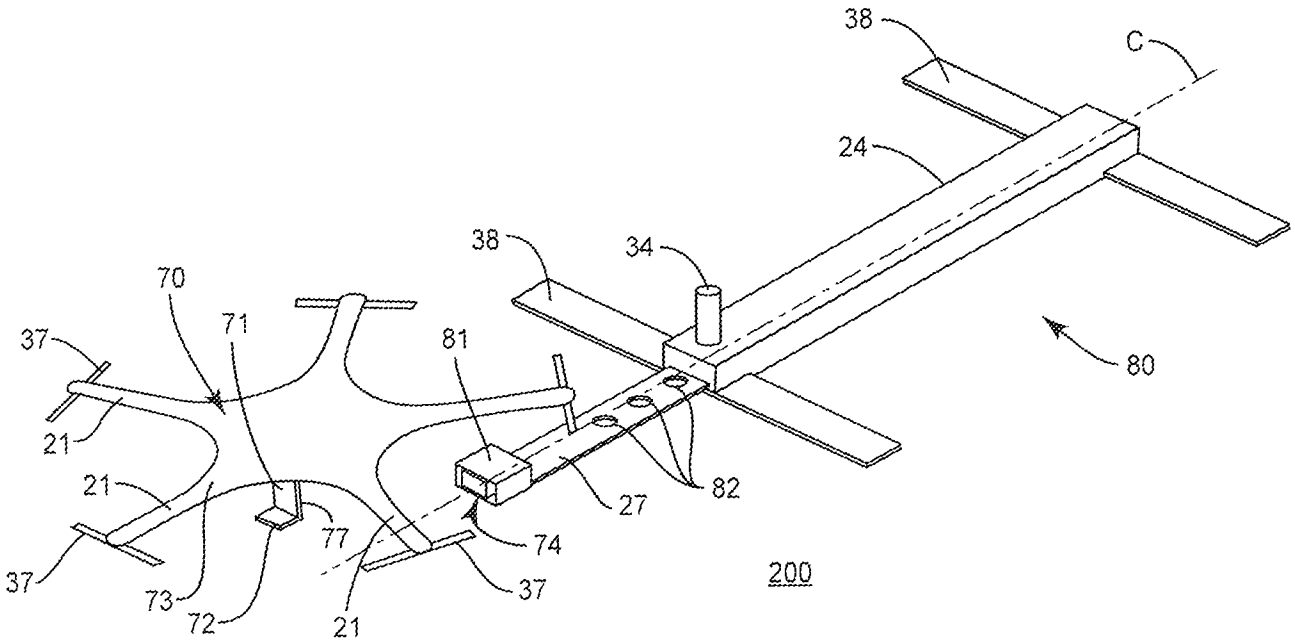
FIG. 5 is a perspective view of a chair support spaced away from an exercising apparatus support.

FIG. 5 illustrates an embodiment of the support structures 70, 80 for the chair 30 and the exercise device 26. Support 70 includes a base 73 sized to be positioned under the chair 30. In one or more embodiments, base 73 matches the general shape of the chair 30. In FIG. 5, base 73 includes five support arms 21 that extend outward from a central region. This shape generally matches the shape of a bottom of an office chair 30. The shape and size of the base 73 may vary. Further, the shape and size may match that of the chair 30, or may include a different shape and/or size.

A mount 71 extends downward from the base 73. In one or more embodiments, the mount 71 is centered on the base 73, and may be positioned to align with the cylinders 35, 36 of a chair. Mount 71 may also be positioned at one of the support arms 21 away from a center of the base 73. Further, the support 70 may include a single mount 71, or multiple mounts 71. The vertical length of the mount 71 measured from the base 73 may vary depending upon the type of chair 30 and the context of use. In one or more embodiments, the mount 71 extends vertically downward from the base 73 when the base 73 is attached to the chair 30. Other embodiments may include the mount 71 extending vertically upward from the base 73.

Mount 71 may include a vertical arm 77 that extends from the base 73. The vertical arm 77 may extend directly downward from the base 73 (i.e., perpendicular to the base 73), or may extend downward at a variety of non-perpendicular angles. Mount 71 further includes an extension 72. The extension 72 may include an exposed terminal end shaped and sized to engage with the support 80. In one or more embodiments, extension 72 is positioned at an end of the vertical arm 77 giving the mount 77 an "L" shape. The vertical arm 77 and extension 72 may include a variety of different shapes and sizes. In one or more embodiments, each is substantially straight with the extension 72 extending outward from a first side of the arm 77 at an angle of 90°.

Support 80 extends through the exercise device 26 and acts as a base for mounting one or more components of the device 26. Support 80 includes the tubing 24 that has an elongated shape to extend through the exercise device 26. Tubing 24 may extend completely through the device 26, or may extend just a majority of the way through the device 26. The tubing 24 includes a hollow interior channel and is sized to receive the flat bar 27 as will be explained below. In one or more embodiments, the tubing 24 includes a flat bottom that corresponds to the flat bar 27 to facilitate sliding of the bar 27 into and out of the tubing 24 for adjustments as necessary. Further, the bottom of the tubing 24 is supported on the floor 200 when the apparatus 10 is in use.

One or more stabilizing bars 38 are attached to and extend laterally outward from the tubing 24. In one embodiment as illustrated in FIGS. 1 and 5, a pair of stabilizing bars 38 is attached to the bottom of the tubing 24 and spaced apart with a first bar 38 positioned towards a front end of the tubing 24 and a second bar 38 positioned towards a back end of the tubing 24.

The flat bar 27 is sized to fit within the interior of the tubing 24 to adjust an overall length of the support 80. The width and size of the bar 27 allows for insertion into the interior of the tubing 24. In one or more embodiments, the width of the flat bar 27 is similar to a width of the inner portion of the tubing 24. This closeness in sizing provides for additional lateral support of the flat bar 27 relative to the tubing 24. One or more apertures 82 may extend through the flat bar 27 and be spaced along the length. The locking device 34 connected with the tubing 24 is sized to extend through the apertures 82. The locking device 34 may be biased to remain engaged with the aperture 82, or may include a mechanical fastener to maintain insertion within one of the apertures 82. In one embodiment, the locking device 34 is positioned just beyond the front of the cover 28 of the exercise device 26.

A receptacle 81 is mounted to a first end of the flat bar 27. The receptacle 81 is sized and shaped to engage with the extension 72 on the mount 71. In one or more embodiments, receptacle 81 includes a frame that extends around and forms an opening 74 sized to receive the extension 72. In one or more embodiments, the opening 74 includes a rectangular shape that matches the shape of the extension 72.

In one or more embodiments, the receptacle 81 is mounted on a top side of the bar 27. This positioning raises the opening 74 above the floor 200 on which the tubing 24 and chair 30 rests. This positioning above the floor 200 facilitates mating between the opening 74 and the extension 72 as will be explained below.

In one or more embodiments, both the tubing 24 and the bar 27 are straight. The bar 27 is positioned in the tubing 24 providing for a telescoping arrangement with each element along a common centerline C. The extension 72 is further aligned with the centerline C when engaged with the receptacle 81.

Figure 6:
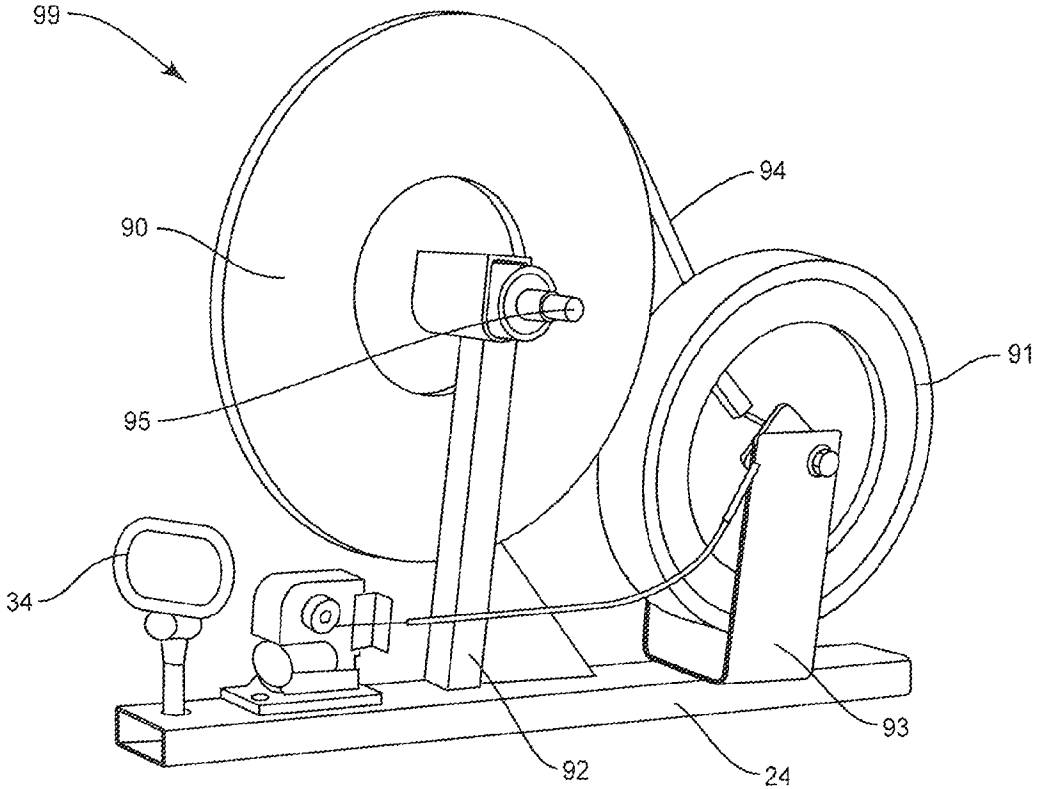
FIG. 6 is a perspective view of an exercising device.

As illustrated in FIG. 6, the internal working components 99 of the exercise device 26 are mounted to the tubing 24. The components 99 include a pulley wheel 90 mounted on an axle 95. Pedals 25 (see FIGS. 1-4) are operatively connected to rotate the wheel 90 during use. A mount 92 attaches the pulley wheel 90 to the tubing 24.

A brake wheel 91 is positioned in proximity to the wheel 90. Brake wheel 91 is attached to the tubing 24 by a mount 93. A belt 94 extends between the pulley wheel 90 and the brake wheel 91. A tensioning device 96 operatively connected to the exercise computer 29 provides for adjusting a tension applied by the brake wheel 91 to adjust the amount of force necessary to for the user to rotate the pulley wheel 90 when pedaling. In one or more embodiments, the components 99 are completely located over the tubing 24 (i.e., no part of the components 99 extends beyond either end of the tubing 24). In one specific embodiment, the tubing 24 has a length of about twenty-four inches (24").

The components 99 include a compact design to reduce the size of the exercise device 26 and thus allow for use under a desk 60 or other confined space. In one embodiment, the radius of the pulley wheel 90 is about seven inches (7") and the axle 95 is positioned about ten inches (10") above the floor. This spacing provides for a compact design, while still allowing for a user to complete a full rotational stroke with the pedals 25 without hitting their feet on the floor 200.

Figure 7:
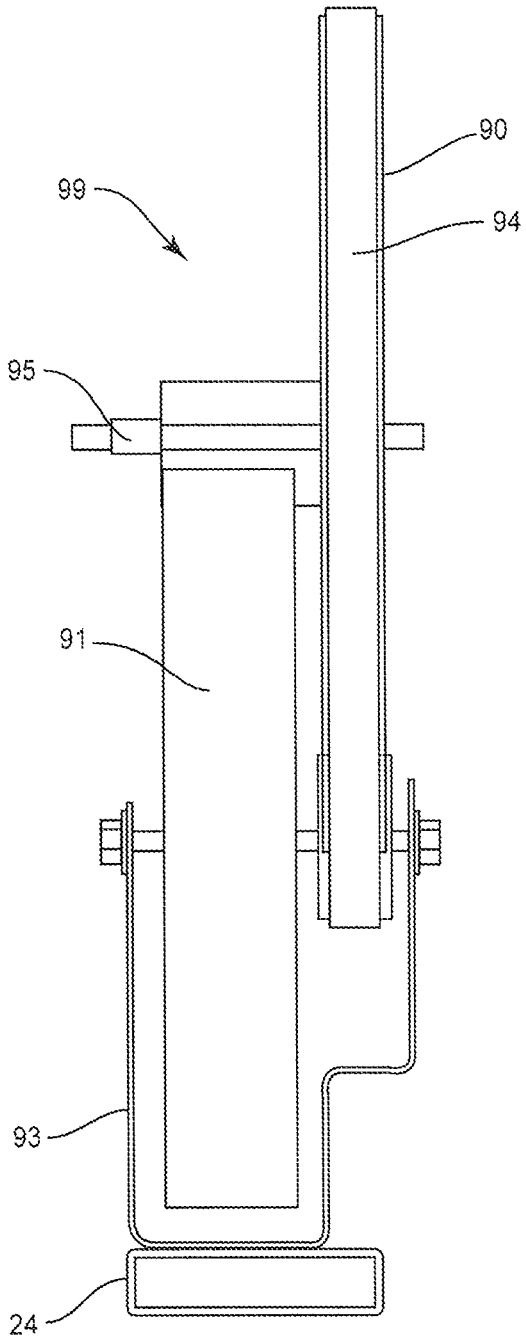
FIG. 7 is a rear view of an exercising device.

The compact design also features a compact width of the exercise device 26. FIG. 7 illustrates a rear view of the internal components 99 mounted to the tubing 24. In this embodiment, the brake wheel 91 is aligned directly over the tubing 24. The pulley wheel 90 may be laterally offset from the brake wheel 91 and the tubing 24. The wheels 90, 91 may further longitudinally overlap as illustrated in FIG. 6

Figure 8:
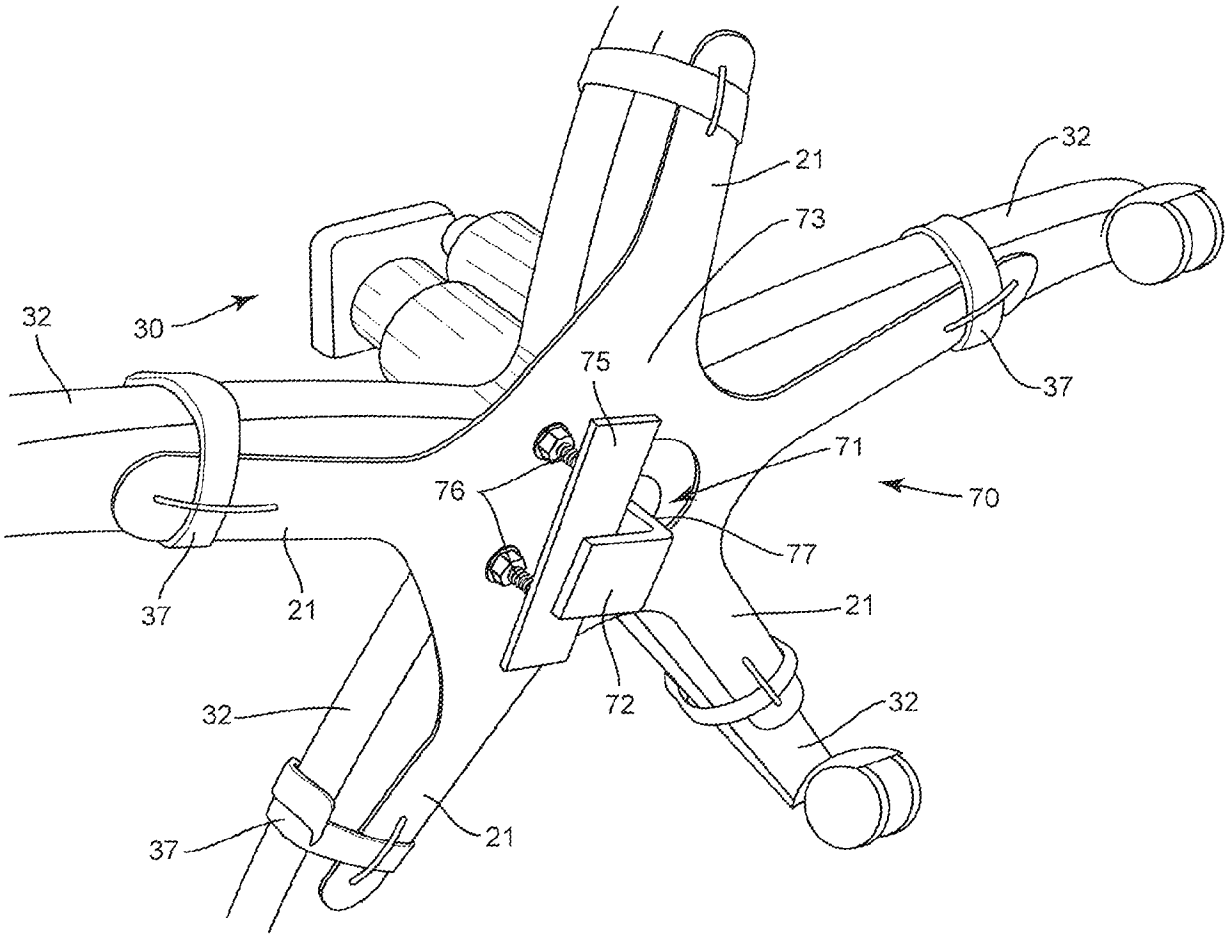
FIG. 8 is a perspective view of a chair support attached to a chair.

FIG. 8 illustrates a bottom view of a support 70 mounted to a chair 30. In this embodiment, the support arms 21 are aligned with chair legs 32 and attached by straps 37. The mount 71 extends downward from a central section of the base 73. The extension 72 is positioned to extend laterally outward to engage with the receptacle 81.

Figure 9:
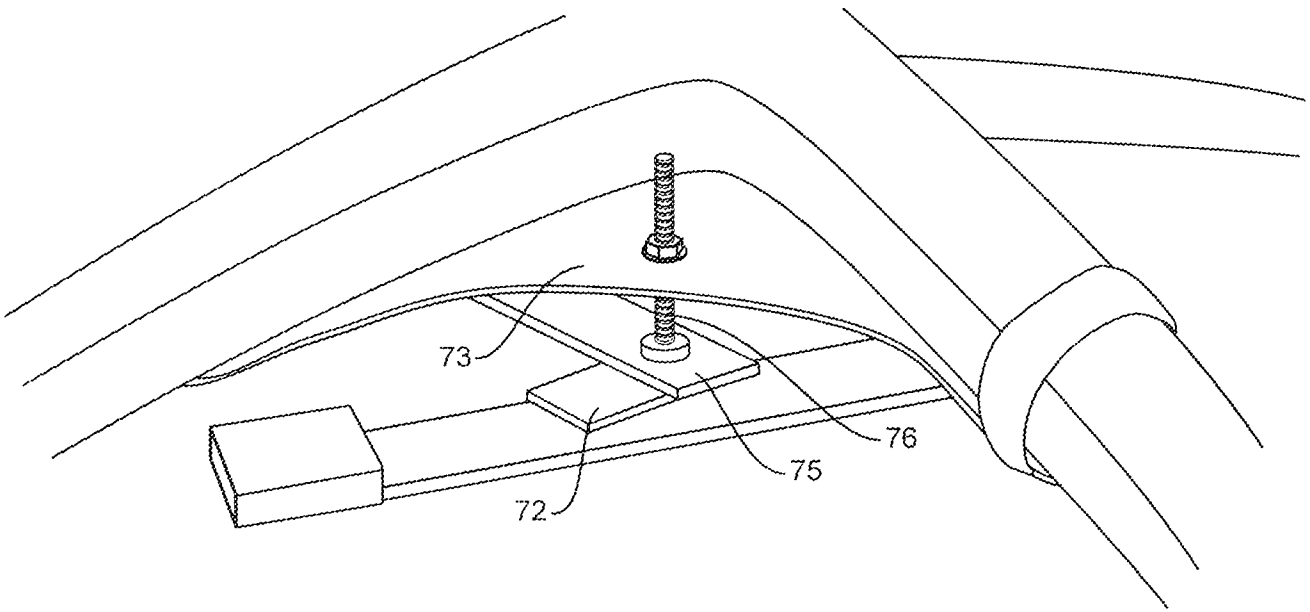
FIG. 9 is a perspective view of a mount adjustably attached to a base of a chair support.

In one or more embodiments as illustrated in FIGS. 8 and 9, the mount 71 includes a vertical arm 77 that extends between the extension 72 on a first end and a support platform 75 on a second end. The support platform 75 is adjustably connected to the base 73 through one or more rods 76. In one embodiment, rods 76 are threaded and engage with corresponding connectors such as a nut to adjust a vertical distance between the platform 75 and the base 73. A user is able to rotate the connectors about the rods 76 to adjust the vertical spacing as necessary.

In one embodiment of use, the user attaches the support 70 to the underside of the chair 30. This may include positioning a central section with a center of the chair and one or more radial arms 21 with corresponding chair legs 32. The support 70 may be attached to the chair 30 using one or more straps 37.

In one or more embodiments, the mount 71 is then vertically adjusted to the desired distance from the base 73. This adjustment may include rotating the connectors on the rods 76 to adjust the distance. In one embodiment, the adjustment of the mount 71 may be performed prior to support 70 being attached to the chair 30.

In one or more embodiments, the extension 72 is spaced away from the floor 200 when the chair 30 is supported on the floor 200. This spacing facilitates attachment with the exercising device support 80.

Further, the bar 27 is adjusted within the hollowing interior channel of the tubing 24. The bar 27 is slid into or out of the tubing 24 to position the second end of the tubing 24 with the receptacle 81 at the desired spacing from the tubing 24. This adjustment provides for positioning the exercising device 26 at the desired spacing from the chair 30. In one embodiment, the bar 27 and the tubing 24 include the same length. This provides for a large amount of length flexibility in adjustment of the overall length. Once positioned at the desired length, the locking device 34 is inserted through an aperture 82 in the bar 27 to set the length.

The receptacle 81 is also engaged with the extension 72 to connect the supports 70, 80. In one or more embodiments, this may include sliding the chair 30 along the floor 200 and inserting the exposed terminal end of the extension 72 into the receptacle 81. In another embodiment, the bar 27 is engaged with the extension 72 prior to fixing the position of the bar 27 with the locking device 34.

Figure 10:
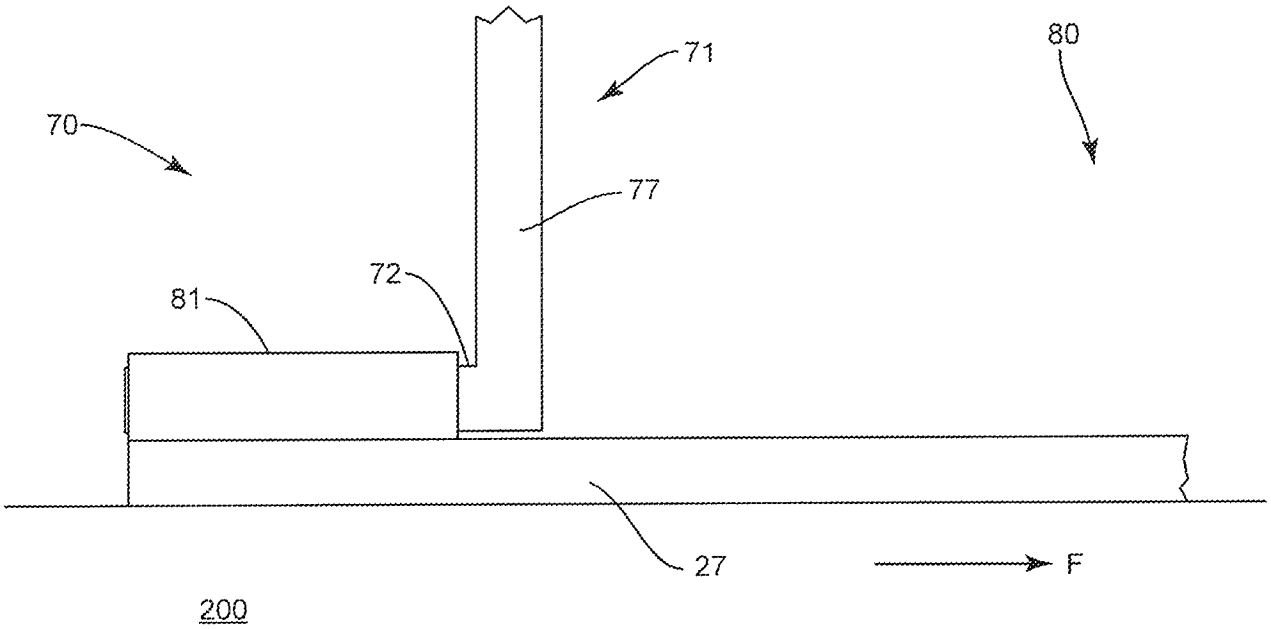
FIG. 10 is a side view of an extension of a mount positioned in a receptacle.

FIG. 10 illustrates one embodiment of the supports 70, 80 attached together. In one or more embodiments, the mount 71 is positioned with the extension 72 facing away from the exercising device 26. The bar 27 is positioned with the receptacle 81 on an opposing side of the vertical arm 77. A bottom side of the extension 72 is placed into contact with a top side of the bar 27, and the extension 72 is then slid into the receptacle 81. Therefore, both the receptacle 81 and the extension 72 are on an opposing side of the vertical arm 77 from the exercising device 26. When a user pedals the exercise device 26, a force F is applied to the support member 80. This force F tends to move the support member 80 away from the support member 70. However, the positioning of the receptacle 81 and mount 71 prevent separation because the mount 81 abuts against the vertical arm 77 to prevent further movement in that direction.

As illustrated in FIG. 10, the receptacle 81 is positioned on the top side of the bar 27. Further, the extension 72 is positioned above the floor 200. The position of the receptacle 81 on the top side provides for engagement with the extension 72. In the embodiment of FIG. 10, the entirety of the bottom of the bar 27 is in contact with the floor 200. Other embodiments may include the second end of the bar 27 positioned away from the floor 200 and the bar 27 at an angle relative to the floor 200.

Attaching the supports 70, 80 together provides stability to the exercising device 26. This provides for the user to apply a force to the pedals 25 during exercise without the device 26 tipping over or separating from the chair 30. In one or more embodiments, the extension 72 is positioned above the floor 200 when engaged with the receptacle 81. In one embodiment, the receptacle is positioned on the top of the bar 27 such that a bottom of the bar 27 remains on the floor to support the apparatus 20. Further, a portion or entirety of the tubing 24 is positioned on the floor 200 to provide support.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An apparatus for exercising when seated in a chair that is positioned on a floor, the apparatus comprising:

an exercising device comprising:

an elongated support member with opposing first and second ends, a flat bottom to be positioned on the floor, an opposing top, and an interior channel extending inward from the first end;

a pedal assembly comprising a first mount attached to the support member between the first and second ends, a wheel attached to the first mount, and pedals operatively attached to the wheel;

a brake assembly comprising a second mount attached to the support member between the first and second ends, the second mount being longitudinally spaced away from the first mount;

an elongated bar sized to fit within the interior channel of the support member and movable within the channel to adjust an amount of the bar extending outward from the first end of the support member, the bar including a first end sized to fit in the hollow interior and an opposing second end positioned away from the support member, the second end including a receptacle;

a chair support comprising:

a base sized to fit on an underside of the chair;

a mount attached to the base and extending vertically outward from the base, the mount including an extension, the extension sized to fit within the receptacle at the second end of the bar to attach together the exercising device and the chair support.

2. The apparatus of claim 1, further comprising a housing that extends around the wheel, the first mount, and the brake assembly, the housing being spaced away from the bottom of the support member.

3. The apparatus of claim 1, wherein each of the interior channel and the bar include rectangular cross-sectional shapes.

4. The apparatus of claim 1, wherein the first wheel is aligned vertically above and directly over the top of the support member.

5. The apparatus of claim 4, wherein the brake assembly includes a wheel attached to the second mount, the brake assembly wheel and the wheel of the pedal assembly being in an overlapping arrangement along a length of the support member and laterally offset.

6. The apparatus of claim 1, further comprising a connector that extends between and connects the base and the mount, the connector adjustable to adjust a distance between the base and the mount.

7. The apparatus of claim 1, wherein the mount includes a vertical member that extends downward from the base when the base is attached to the chair, the extension extending perpendicularly outward from the vertical member.

8. An apparatus for exercising when seated in a chair that is positioned on a floor, the apparatus comprising:

an exercising device comprising:

a base with an open channel;

a pedal assembly mounted to the base;

an elongated bar including opposing first and second ends, the bar being sized to fit within and be movable along the channel to selectively position the second end outward from the channel and away from the base;

a receptacle at the second end of the bar;

a chair support comprising:

a plate sized to fit on an underside of the chair;

a mount comprising a vertical arm and a horizontal extension, the extension sized to engage with the receptacle;

at least one connector that extends between the plate and the mount to adjust a distance between the plate and the mount;

the extension sized to engage with the receptacle at the second end of the bar to attach together the exercising device and the chair support.

9. The apparatus of claim 8, wherein the plate includes a central section and a plurality of radially extending arms, the mount being positioned directly below the central section.

10. The apparatus of claim 8, wherein each of the extension, the bar, and the base include substantially straight shapes that align together in a straight row when the exercising device is attached to the chair support.

11. The apparatus of claim 8, wherein the receptacle is positioned on a top side of the bar to engage with the extension when the extension is spaced away from the floor.

12. The apparatus of claim 8, wherein the pedal assembly is mounted directly over the base.

13. The apparatus of claim 8, wherein the extension extends outward at an angle of 90 degrees from the vertical arm.

14. The apparatus of claim 8, wherein the extension includes a solid, substantially rectangular shape and the receptacle includes a substantially rectangular opening sized to receive the extension.

15. The apparatus of claim 8, further comprising a locking mechanism attached to the base to lock the position of the bar relative to the base.

16. A method of attaching an exercise device to a chair comprising:

attaching a chair support to an underside of the chair, the chair support including an extension;

positioning the exercise device in proximity to the chair, the exercise device including a base with a pedal assembly extending upward from the base;

adjusting a bar within a channel in the base to position a receptacle at an end of the bar outward away from the base;

locking a position of the bar relative to the base;

positioning the chair relative to the exercise device with the extension facing away from the pedal assembly and the extension positioned between the receptacle and the pedal assembly;

aligning the bar and the base with a terminal end of the extension; and mating the receptacle at the end of the bar with the terminal end of the extension by increasing a distance between the chair and the pedal assembly.

17. The method of claim 16, further comprising mating the receptacle at the end of the bar with the terminal end of the extension while the extension is positioned vertically above a floor that supports the chair.

18. The method of claim 16, further comprising engaging a pin of a locking device with an aperture in the bar and locking the position of the bar relative to the base.

19. The method of claim 16, further comprising aligning arms that extend outward from a central portion of the chair support along undersides of legs on the chair.

20. The method of claim 16, further comprising positioning the chair support directly under a center of the chair.

* * * * *